US009312604B2

(12) United States Patent
Chen et al.

(10) Patent No.: US 9,312,604 B2
(45) Date of Patent: Apr. 12, 2016

(54) BOUNDARY RADIATION PREVENTION STRUCTURE AND ELECTRONIC CABINET AND ELECTRONIC WORKING PLATFORM USING THE BOUNDARY RADIATION PREVENTION STRUCTURE

(71) Applicant: CLARIDY SOLUTIONS, INC., Hsinchu (TW)

(72) Inventors: Horng Ji Chen, Hsinchu (TW); Yu Ting Hsiao, Hsinchu (TW); Che Fu Lin, Hsinchu (TW); Lin Chi Choo, Hsinchu (TW)

(73) Assignee: CLARIDY SOLUTIONS, INC., Hsinchu (TW)

( * ) Notice: Subject to any disclaimer, the term of this patent is extended or adjusted under 35 U.S.C. 154(b) by 558 days.

(21) Appl. No.: 13/859,522

(22) Filed: Apr. 9, 2013

(65) Prior Publication Data

US 2014/0145869 A1 May 29, 2014

(30) Foreign Application Priority Data

Nov. 23, 2012 (TW) ..... 101222781 U

(51) Int. Cl.
*H01Q 17/00* (2006.01)
*H01Q 1/22* (2006.01)
*H01Q 1/52* (2006.01)

(52) U.S. Cl.
CPC ..... *H01Q 17/00* (2013.01); *H01Q 1/2208* (2013.01); *H01Q 1/526* (2013.01)

(58) Field of Classification Search
CPC ..... H01Q 17/00; H01Q 1/2208; H01Q 1/526
USPC ..... 342/1–4, 42, 44, 175; 174/390, 377
See application file for complete search history.

(56) References Cited

U.S. PATENT DOCUMENTS 5,128,678 A * 7/1992 Novak ..... B64C 1/38 342/2
6,097,327 A * 8/2000 Byquist ..... H01Q 1/28 342/1
6,304,209 B1 * 10/2001 Noda ..... H01Q 17/008 342/1

(Continued)

FOREIGN PATENT DOCUMENTS

TW M379122 4/2010

OTHER PUBLICATIONS

Noor, A.; Hu, Z., "Effects of spacer parameters on resistive Hilbert curve array absorbers," in Microwave Conference, 2009. APMC 2009. Asia Pacific , vol., no., pp. 602-605, Dec. 7-10, 2009.*

*Primary Examiner* — John B Sotomayor
(74) *Attorney, Agent, or Firm* — Muncy, Geissler, Olds & Lowe, P.C.

(57) ABSTRACT

The invention provides a boundary radiation prevention structure, comprising: a metal portion, and a guide portion. The metal portion has an incident plane adapted to block an incident electromagnetic wave, wherein the incident electromagnetic wave induces an induced current on the incident plane. The guide portion is located on one border of the incident plane and has a curved surface electrically connected to the metal portion for the induced current to pass through, wherein the curved surface is covered by an absorption layer for absorbing the incident electromagnetic wave and a boundary radiation generated from the induced current radiation.

18 Claims, 9 Drawing Sheets

(56) References Cited

U.S. PATENT DOCUMENTS 8,917,202 B2 * 12/2014 Grosinger ..... G01S 7/412 340/425.1
2006/0170583 A1 * 8/2006 Marin Palacios .... H01Q 17/002 342/1
2006/0202883 A1 * 9/2006 Treen ..... H01Q 17/00 342/1
2011/0095932 A1 * 4/2011 Winebrand ..... H05K 9/0001 342/4
2012/0306712 A1 * 12/2012 Iwanaka ..... H01Q 15/14 343/781 P
2013/0135135 A1 * 5/2013 Appleton ..... B32B 33/00 342/1
2014/0145869 A1 * 5/2014 Chen ..... H01Q 17/00 342/1

* cited by examiner

BOUNDARY RADIATION PREVENTION STRUCTURE AND ELECTRONIC CABINET AND ELECTRONIC WORKING PLATFORM USING THE BOUNDARY RADIATION PREVENTION STRUCTURE

BACKGROUND OF THE INVENTION

1. Field of the Invention

The present invention relates to a boundary radiation prevention structure. In particular, the present invention relates to a boundary radiation prevention structure for blocking and absorbing the electromagnetic wave radiating to protect the system from interferences.

2. Description of the Related Art

Nowadays technology of RFID (Radio Frequency Identification) has a fruitful development. Because of its appropriate acting distance, affordable cost, small volume, enduring life cycle, and free of battery, RFID is widely used in a variety of fields. For example, it can be applied in as the following fields: labels in supermarket, plastic money for debit and stored-value, electronic key, book position searching in the library and the like.

When applying the RFID, at least one RFID tag attached to an object or a stock keeping unit (SKU) to record information and at least one antenna for detecting the MID tag are needed. The antenna is electrically connected (such as using RF coaxial cable) to the RFID reader so that transmitting and receiving of signals are achieved. Each of the objects or SKUs is matched with an RFID tag, and the system gets the information of the objects or SKUs (called "object information" for short) automatically via detecting their RFID tags. When the RFID technology is applied in searching location of specific objects, practically a control system connected to at least one RFID reader is needed. The reader connects to multiple antennas which are placed in different locations so that it can detect the locations of the objects with their correspondent RFID tags.

However, due to the electromagnetic wave radiation, if the regions for placing objects are too close to each other, the electromagnetic waves from the reader and tags are easily to spill to other regions when a traditional compartment is used. Therefore, one RFID reader antenna detects the signals from the RFID tags locating not only in the antenna predefined region but also in the other nearby regions, leading to an error position determination, so that the control system is unable to determine the position of the object corresponding to the RFID tag correctly.

Among such shortcomings, applying to the cabinet for placing objects is more annoying. Taiwan Patent Number M379122 discloses a remote-controlled electronic bookshelf device, comprising at least one bookcase and a remote control host, wherein an RFID reader is in each bookcase, and each book in the bookcase is attached with an RFID tag having an unique identifier. The remote control host is separated to the bookcases and is connected to the RFD reader. A database of all identifiers of books is stored in the remote control host, and another RFID reader is used for reading the identifier of the MID tag so that remote control of borrowing and returning books is achieved. However, electromagnetic wave in this kind of bookcase will spill out to another region by radiation and the signals of RFID tags would interfere to each other so that the RFID reader cannot identify the location of books correctly, and the electronic bookshelf cannot perform the book locating function properly.

FIG. 1 and FIG. 2 are schematic diagrams of electronic bookshelf. In order to avoid the electromagnetic wave 400 across two compartments 200 causing signal interference, a metal plane 300 is set between the two compartments 200 as a shielding and the metal plane 300 can prevent the electromagnetic wave 400 from spill over to adjacent compartment 200. Therefore, the antenna 13 in each compartment 200 can read the object information correctly. However, when the electromagnetic wave 400 radiates to the metal plane 300, it induces an induced current on the surface of the metal plane 300. When the induced current passes to the edge of metal plane 310, it emits a boundary radiation 500 from the edge of the metal plane 300. Therefore, the RFID reader antenna might detect the signals of tags from other compartment via boundary radiation 500.

SUMMARY OF THE INVENTION

The purpose of present invention is to provide a boundary radiation prevention structure for solving the foregoing problem of the prior art. In the prior art, the electromagnetic wave leaks along the edge, border or corner of the structure (that is the so-called "boundary radiation") so that the antenna receives the unexpected radio signals from the other compartment, which causes the system to detect the position of the electronic tags incorrectly.

To solve the foregoing problem, one aspect of the present invention is to provide a boundary radiation prevention structure, comprising: a metal portion, which has an incident plane adapted to block an incident electromagnetic wave from penetrating, wherein the incident electromagnetic wave induces an induced current on the incident plane; and a guide portion, which is located on one border of the incident plane and has a curved surface electrically connected to the metal portion for the induced current to pass through, wherein the curved surface is covered by an absorption layer for absorbing the incident electromagnetic wave and a boundary radiation generated from the induced current radiation.

Another aspect of the invention is to provide an electronic cabinet with a boundary radiation prevention structure for placing at least one object attached with an electronic tag, wherein the electronic cabinet includes a plurality of compartments, each compartment comprises: at least one antenna for coupling to the electronic tags; a plurality of metal portions, each metal portion is located between two compartments and has two incident planes corresponding to the compartments respectively for blocking the incident electromagnetic wave across to another compartment, wherein the incident electromagnetic wave induces an induced current on the incident plane; and a plurality of guide portions, which are located between two incident planes and each guide portion has a curved surface electrically connected to the metal portion for the induced current to pass through, wherein the curved surface is covered by an absorption layer for absorbing of the incident electromagnetic wave and a boundary radiation generated from the induced current radiation.

Another aspect of the invention is to provide an electronic working platform with boundary radiation prevention structure for placing at least one object attached with an electronic tag, wherein the working platform comprises: an antenna for coupling to the electronic tag; a configuration container, comprising a top surface portion, a metal receptacle containing the antenna inside, and a plurality of guide portions located between the top surface portion and the edge or border of the metal receptacle, wherein the metal receptacle includes an incident surface for blocking an incident electromagnetic wave which induces an induced current on the incident surface, and the guide portion has a curved surface electrically connected to the metal portion for the induced current to pass through, and the curved surface is covered by an absorption layer for absorbing the incident electromagnetic wave and a boundary radiation generated from the induced current radiation.

Therefore, the present invention has some availability benefits as follows:

1. According to the electronic cabinet of the present invention, the curved surface of the guide portion which is located between the two incident planes of the metal portion spreads the boundary radiation generated from the induced current radiation evenly, and the absorption layer which covers the curved surface and absorbs the boundary radiation completely. Therefore, the situation that two or more antennas located in different compartments detect the information from the same electronic tag via the boundary radiation is avoided.

2. The guide portion of the present invention guides the evanescent wave to disseminate along the curved surface, so that the evanescent wave decreases exponentially and finally be absorbed by the absorption layer completely.

3. In the present invention, the compartments is surrounded by the metal portions, so that the incident electromagnetic wave cannot across from one compartment to another compartments to prevent the electronic tag's from being detected incorrectly.

4. In the present invention, the electronic working platform blocks the boundary radiation to leak out from the working platform by the metal receptacle containing the antenna with the boundary radiation prevention structure. Therefore, it can be avoided that the antenna detects other electronic tags outside of the expected region.

To improve understanding of the different aspects of the disclosure, the techniques employed in the patent invention to achieve the foregoing problems, characteristics and effects thereof are described hereinafter by the way of examples with reference to the accompanying drawings.

DETAILED DESCRIPTION OF THE PREFERRED EMBODIMENTS

Figure 1:
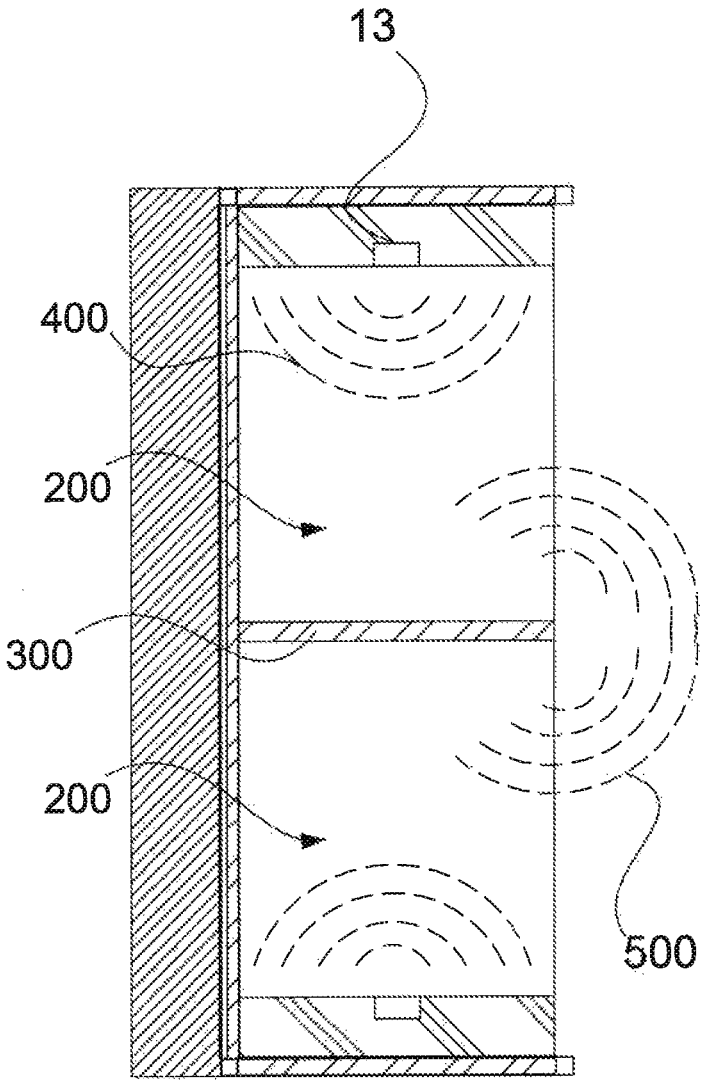
FIG. 1 shows a cross-section schematic diagram illustrating a conventional electronic bookshelf and the boundary radiation.
Figure 2:
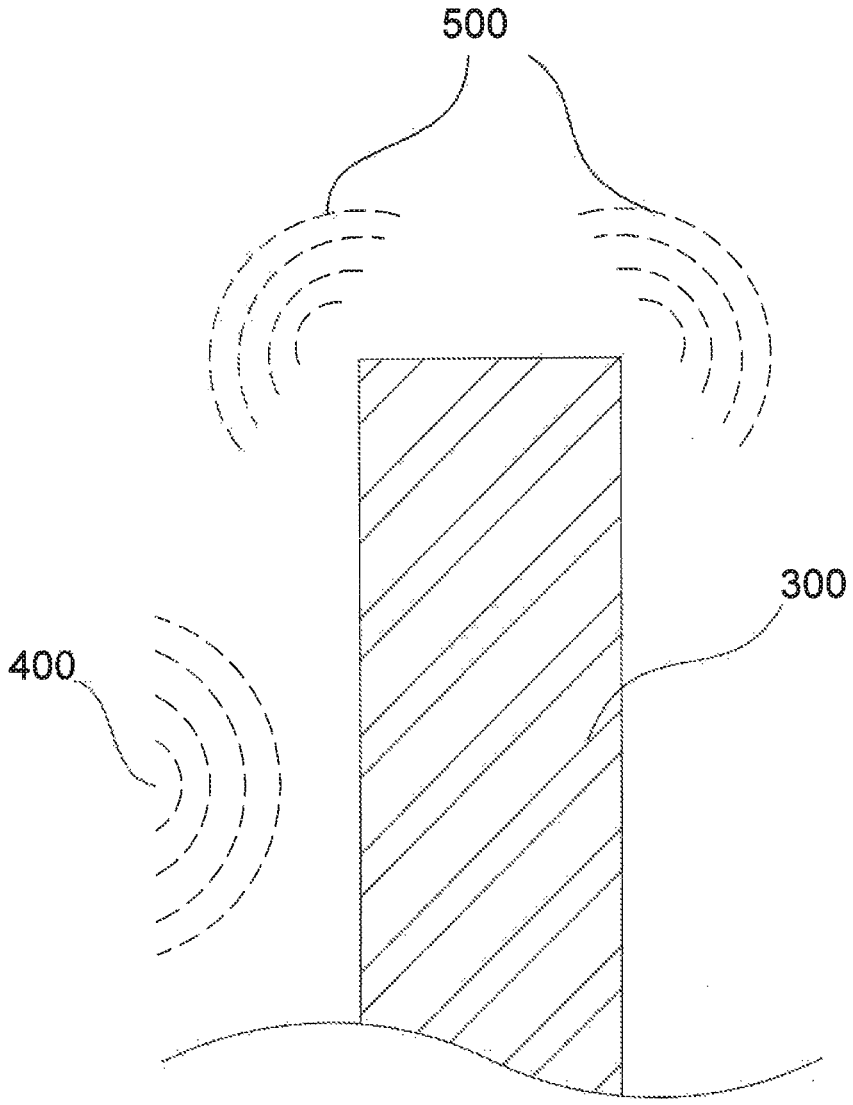
FIG. 2 shows a cross-section schematic diagram illustrating a conventional metal plane and the boundary radiation.

In the following detailed description, only certain exemplary embodiments the present invention are shown and described, by way of illustration. As those skilled in the art would recognize, the described exemplary embodiments may be modified in various way all without departing from the spirit or scope of the present invention.

The drawing and description are to be regarded as illustrative in nature, and not restrictive.

The technical contents of the present invention will become apparent with the detailed description of preferred embodiment.

The term "electrically connecting" used in the present invention refers to a device/part connects to other device/part by a physical wire for transmitting a signal to each other. Therefore, two or more devices/parts connected with a conductor physically (such as conducting wire, RF coaxial cable, conducting material, etc.,) belong to the term "electrically connecting" in the present invention.

When the electromagnetic wav incident on a conductor, it induces an induced current on the surface of the conductor. The current density of induced current decreases exponentially as distance from the surface increases. This phenomenon is called "Skin Effect," and the "Skin Depth" is getting thinner while the frequency increases. For example, when the HF (High frequency) is 13.56 MHz, the skin depth is smaller than 23 μm in Cu, Al, and Fe. When the UHF (Ultra high frequency 915 MHz, the skin depth is smaller than 3 μm in Cu, Al, and Fe. Therefore, the electromagnetic wave of HF or UHF induces a current on the surface of metal plate but not penetrates the metal plate.

Figure 3:
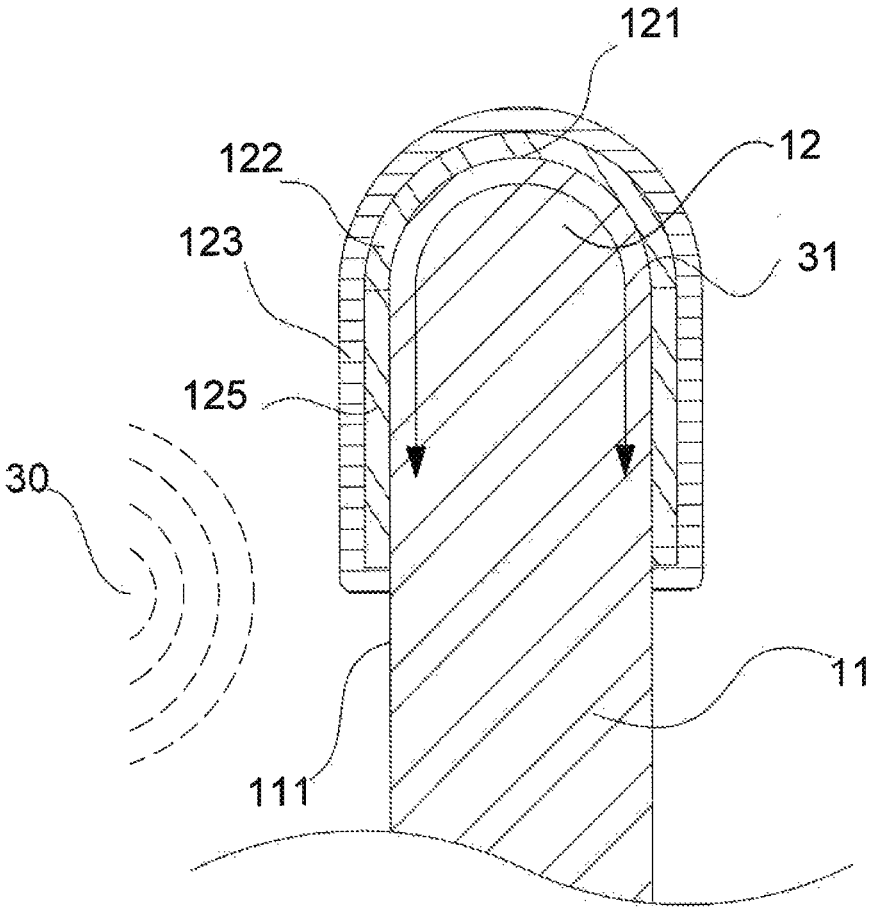
FIG. 3 shows an exemplary embodiment of the electromagnetic wave transmission path in the boundary radiation prevention structure of the present invention.

In connection with the present invention, please refer to FIG. 3, which shows an exemplary embodiment of the electromagnetic wave transmission path of the boundary radiation prevention structure. As shown in the figure, the boundary radiation prevention structure comprises a metal portion 11 and a guide portion 12. The metal portion 11 has an incident plane 111 adapted to block an incident electromagnetic wave 30 from penetrating. The incident electromagnetic wave 30 induces an induced current 31 on the incident plane 111. The guide portion 12 is located on one border of the incident plane 111 and has a curved surface 121 electrically connected to the metal portion 11 for the induced current 31 to pass through, wherein the curved surface 121 is covered by an absorption layer 122 for absorbing electromagnetic wave. When the induced current 31 passes through the curved surface 121, it spreads out a boundary radiation outside of the metal portion 11 evenly. The curved surface 121 prevents the boundary radiation from partial local concentration so that the absorption layer 122 can absorb the boundary radiation completely.

At the same time, when electromagnetic wave is incident on the conductor, an evanescent wave (not shown) generates and transmits along the surface of the conductor, the strength of evanescent wave decreases exponentially as transmission distance increases. The evanescent wave is prone to radiate at the corner of the medium junction on the traditional structure. Contrary, the curved surface 121 of the present invention for the evanescent wave to pass through and eventually fade away. The absorption layer 122 is a coating material or a thin layer on the curved surface 121. The way of the absorption layer 122 covers the curved surface 121 is not restricted. The absorption layer 122 is composed of a coating material, such as mixture of absorbents (for example, mixture of radiation absorbable metal or powder, like iron oxide) and adhesives.

Therefore, coating or covering the absorption layer 122 on the curved surface 121 would not be restricted by the surface shape of the guide portion 12, and the convenience of manufacture process is enhanced. The absorption layer 122 can also be a composite material or a polymer material. The absorption layer 122 absorbs the electromagnetic radiation energy by resonance and transforms the above energy into heat via coupling. In addition, since different kinds of materials can absorb energy in different frequency band, mixture material could expand the frequency band. Furthermore, the absorption layer 122 has an extended portion 125 extending and covering from the curved surface 121 to the incident plane 111. The extended portion 125 absorbs the energy before the incident electromagnetic wave 30 transmits to the incident plane 111, thus a better effect of preventing the boundary radiation is achieved. In order to prevent the absorption layer 122 from abrasion, it is surrounded by a protective sleeve 123. With the above mentioned structure, the present invention is adapted to block the electromagnetic wave and prevent the boundary radiation generated from the induced current 31 from leaking.

In order to improve understanding of the different aspects of the present invention, two preferable embodiments are provided as follows.

Figure 4:
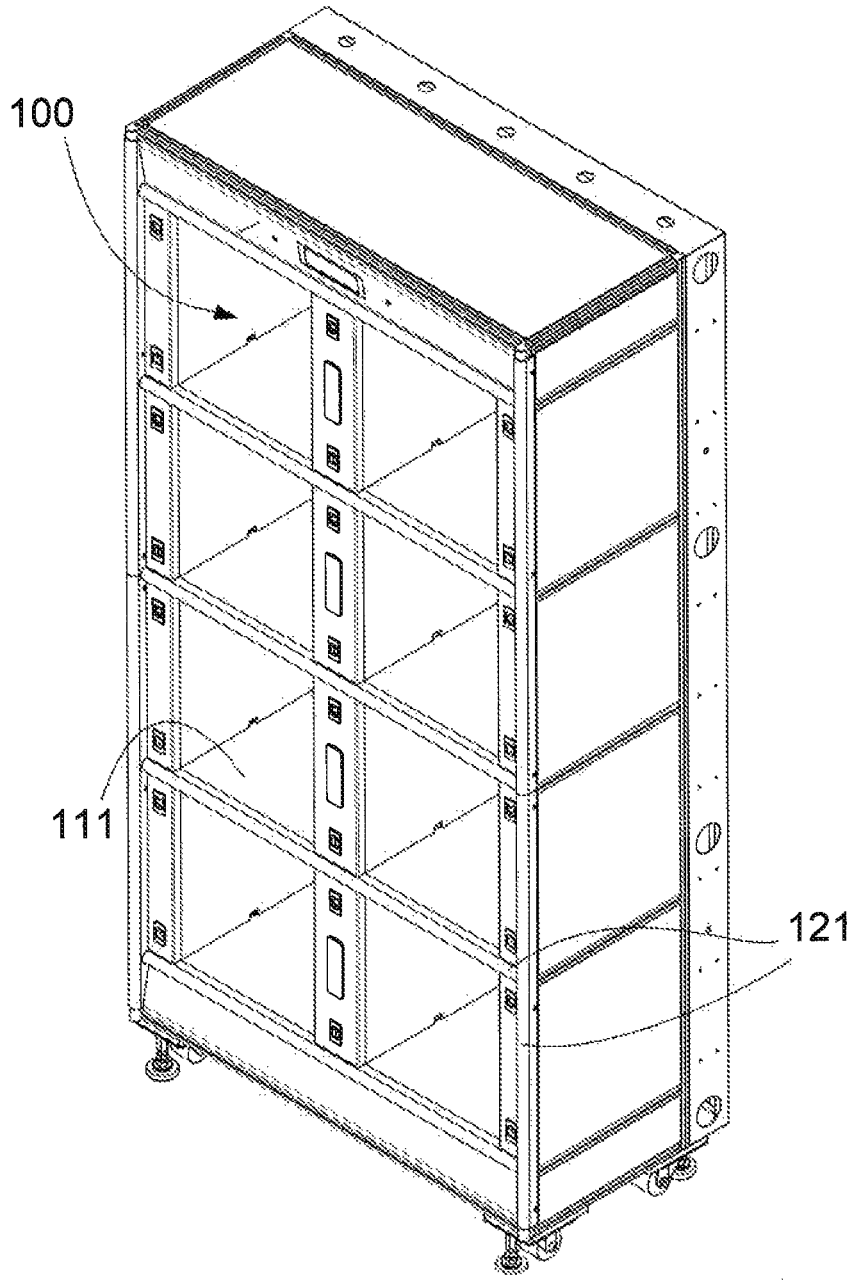
FIG. 4 shows a schematic diagram illustrating the appearance of the electronic cabinet of the present invention.
Figure 5:
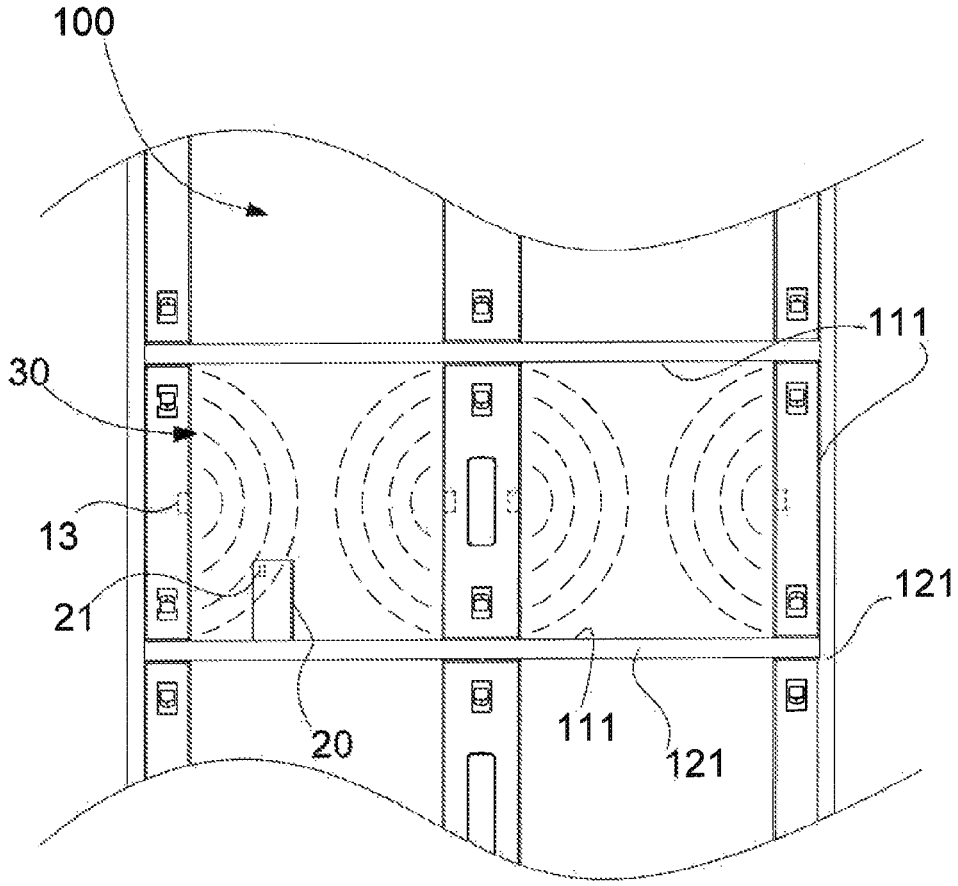
FIG. 5 shows a schematic diagram of the front view of the electronic cabinet of the present invention.

Please refer to FIG. 4 and FIG. 5, which show schematic diagram of an appearance and front view of an electronic cabinet of the present invention respectively. As the figure shows: the electronic cabinet includes a plurality of compartments 100 for placing at least one object attached with an electronic tag; each compartment 100 comprises at least one antenna 13, a plurality of metal portions 11, and a plurality of guide portions 12 located on one border of the metal portion 11. The antenna 13 is used for detecting the electronic tag 21. Each metal portion 11 is located between two compartments 100 and includes two incident planes 111 corresponding to the compartment 100 respectively for blocking the incident electromagnetic wave 30 across to another compartment 100. The incident electromagnetic wave 30 induces an induced current 31 on the incident plane 111. The guide portions 12 is located between two incident planes 111 and each guide portion 12 has a curved surface 121 electrically connected to the metal portion 11 for the induced current 31 to pass through. It is understood that traditional metal pieces have angles on its corners, such as a sheet metal bending has an arc angle having radius of approximately 3 to 4 mm. However, the curved surface 121 of present invention extends from the two incident planes 111, and is different from the arc angle of the traditional metal parts. The curved surface 121 is further covered by an absorption layer 122 for absorbing the incident electromagnetic wave 30 and the boundary radiation generated from the induced current 31.

Regarding the electronic tag 21, it can be the Active-REID tag, Passive-RFID tag, NEC device or any carrier for carrying information that can be used in radio communication. In an exemplary embodiment of present invention, the electronic tag 21 is a Passive-RFID tag. It should be understood that the exemplary embodiment is only for illustrating the present invention but not to restrict the scope of claims.

In order to detect the compartment 100 where the object 20 is located, at least one tag recognition unit (non-shown) connected to the antenna 13 for accessing the information of the electronic tag 21 is contained in the electronic cabinet to read the information of the objects 20 located in the compartments 100. The tag recognition unit matches the electronic tag 21; if the electronic tag 21 is an RFID tag, the tag recognition unit is an RFID reader. The antenna 13 is coupled to the electronic tag 21 for transmitting the information of the object 20 to the tag recognition unit, so that the location of the object 20 in which compartment 100 having the coupling antenna 13 can be known. In this exemplary embodiment, the tag recognition unit is connected to a plurality of antennas 13 in a plurality of the compartments 100 to achieve the goal of position detection. However, the number of the antenna 13 or the tag recognition unit is not restricted.

Figure 6:
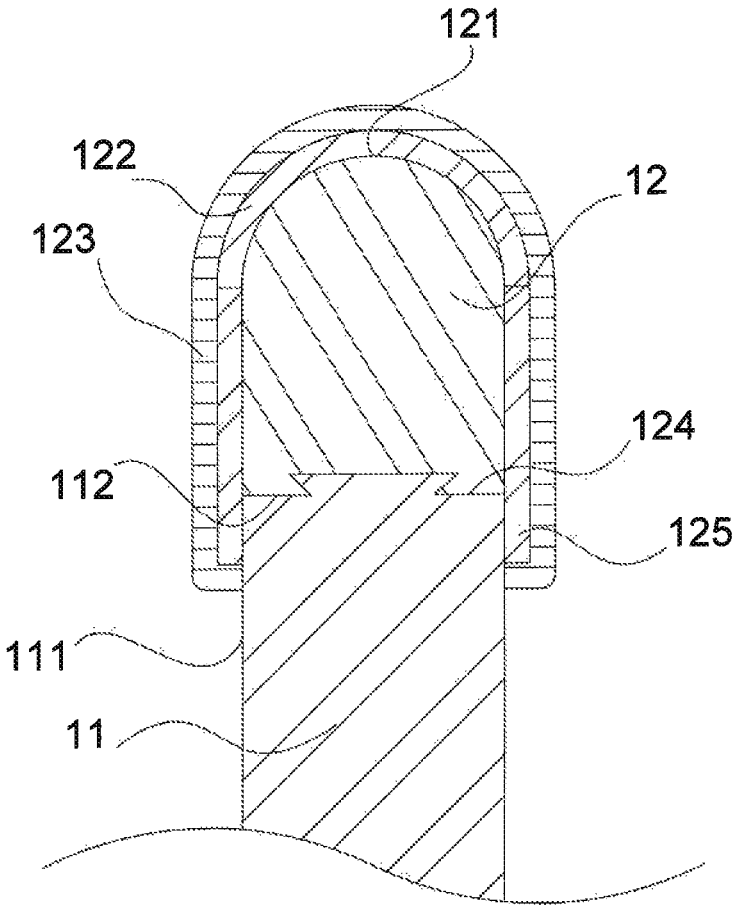
FIG. 6 shows an exemplary embodiment of the electromagnetic wave transmission path in the electronic cabinet with boundary radiation prevention structure of the present invention.

Please refer to FIG. 6, it is a schematic diagram showing the electromagnetic wave transmission path in the electronic cabinet of the present invention. As the figure shows, the metal portion 11 further comprises a first connecting part 112 for connecting a second connecting part 121 of the guide portion 12. Therefore the metal portion 11 and the guide portion 12 can be assembled or disassembled conveniently. As mentioned above, the covering area of the absorption layer 122 has an extended portion 125 extended from the curved surface 121 to the incident plane 111. The extended portion 125 covers the surface junction between the metal portion 11 and the guide portion 12 to ensure that the boundary radiation spills out from the corner would be absorbed completely.

Figure 7:
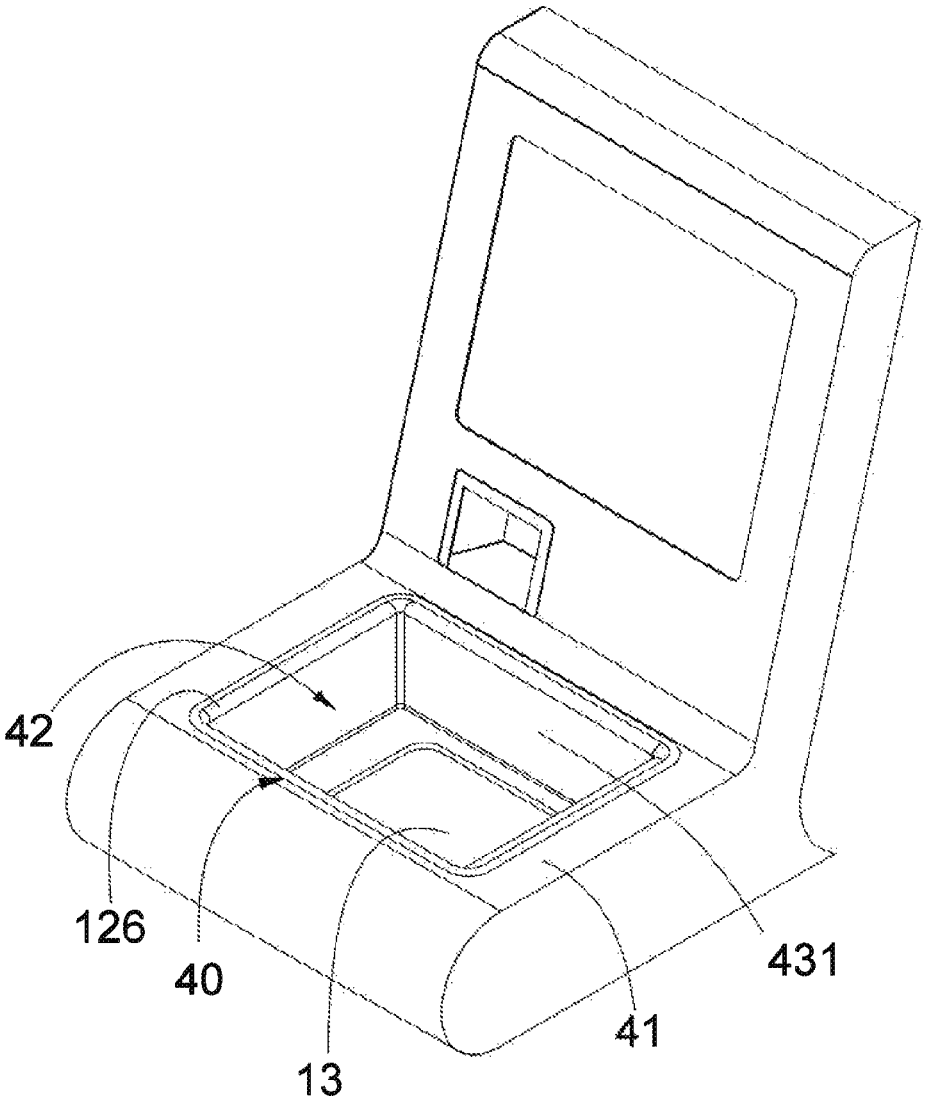
FIG. 7 shows a schematic diagram of the appearance of the working platform boundary radiation prevention structure of the present invention.
Figure 8:
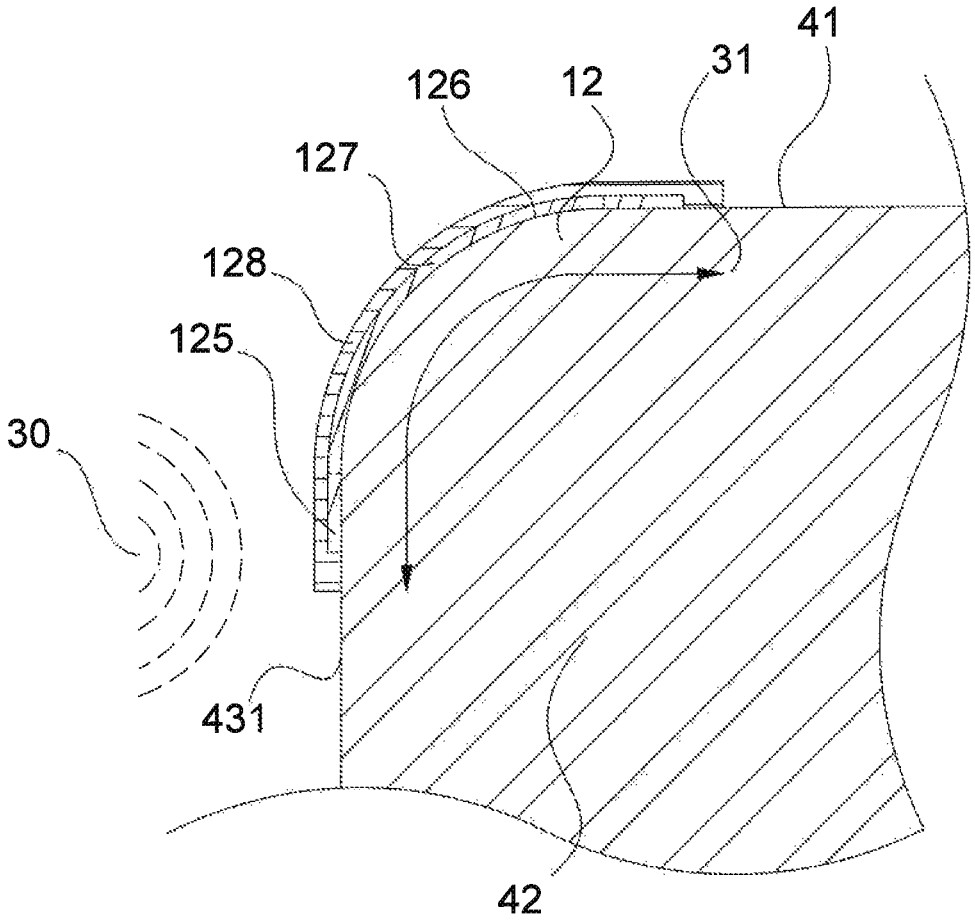
FIG. 8 shows an exemplary embodiment of the electromagnetic wave transmission path in the working platform with boundary radiation prevention structure of the present invention.
Figure 9:
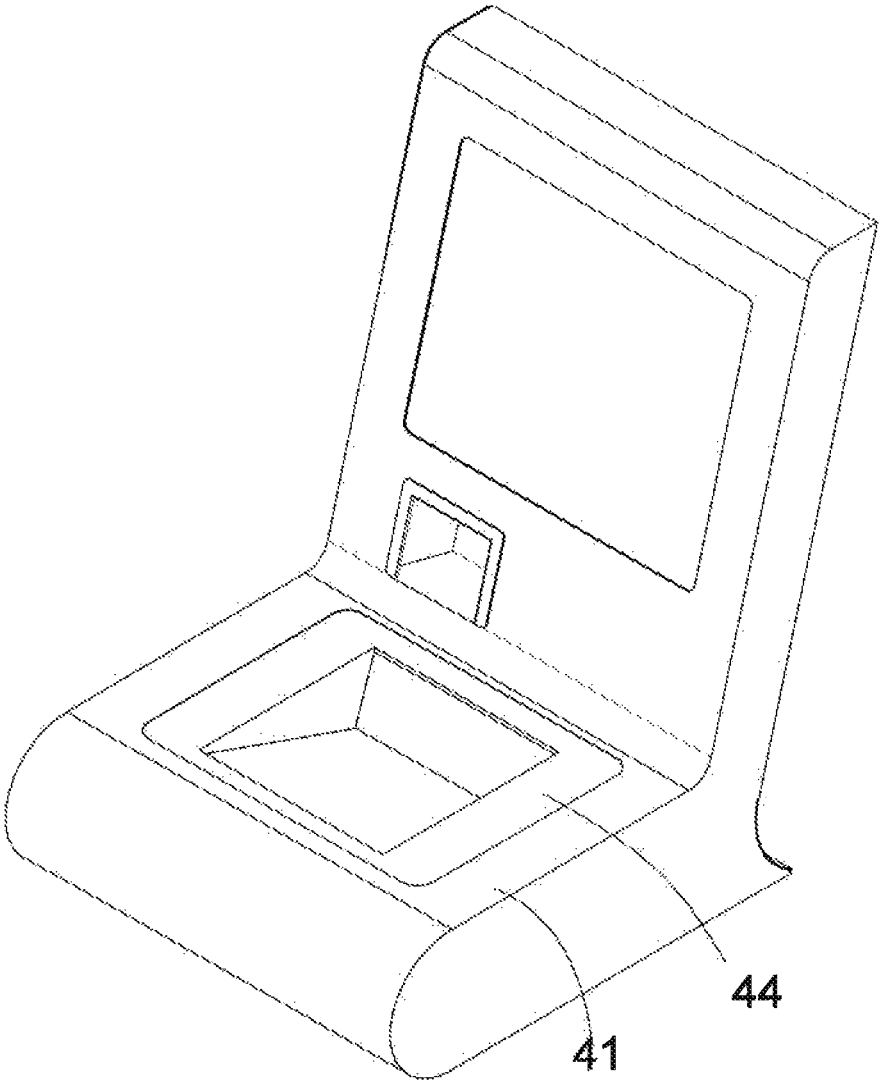
FIG. 9 shows a schematic diagram of the electronic platform with boundary radiation prevention structure combined with the nonconductive portion.

Please refer to FIG. 7 to FIG. 9, which show the working platform appearance, the electromagnetic wave transmission path, and front view of the other exemplary embodiment of the present invention. As the figures show, the exemplary embodiment of present invention discloses an electronic working platform with boundary radiation prevention structure. The electronic working platform is defined as a working platform able to access the information of the electronic tag 21 via a tag recognition unit (non-shown). The tag recognition unit connected to the antenna 13 for accessing the information of the electronic tag 21 is contained in the electronic working platform to read the information of the objects 20. More specifically, this working platform can be applied to the circulation desk, checkout counter, or other kinds of scanning platforms for controlling access of the objects. The electronic working platform comprises an antenna 13, and a configuration container 40. The configuration container 40 comprises a top surface portion 41, a metal receptacle 42 for containing the antenna 13, and a plurality of guide portions 12 located between the top surface portion 41 and the metal receptacle 42. The metal receptacle 42 is composed of conductive material as the metal portion 11 as above mentioned embodiments, and the surface of the metal receptacle 42 is formed by a group of planes selected from a plurality of rectangle planes, or a plurality of curved surfaces jointed together, but is not limited to these planes or surfaces. Additionally, the surface of metal receptacle 42 is an incident surface 431 for blocking the incident electromagnetic wave 30, wherein the incident electromagnetic wave 30 induces an induced current 31 on the incident surface 431. The guide portion 12 has a curved surface 126 electrically connected to the metal receptacle 42 for the induced current 31 to pass through, wherein the curved surface 126 is covered by an absorption layer 127 for absorbing the incident electromagnetic wave 30 and a boundary radiation generated from the radiation of the induced current 31. The absorption layer 127 is surrounded by a protective sleeve 128. Furthermore, the metal receptacle 42 has a non-conductive portion 44, which is composed of non-conductive insulating material, and could be shaped as a platform, curved groove, chute or other modified geometric structure for placing the object conveniently, can be set on the metal receptacle 42. The modification of the geometric structure of the non-conductive portion 44 is only for assisting the application of the electronic working platform, but not to restrict the scope of claims.

According to the above mentioned structure, the electronic working platform of present invention can prevent the boundary radiation from spreading and the other electronic tags 21 located outside of the electronic working platform will not be detected by the antenna 13 in the metal receptacle 42.

In conclusion, the boundary radiation which is generated from the induced current spreads out evenly by the curved surface of the guide portion of the boundary radiation prevention structure of the present invention, and finally be absorbed completely by the absorption layer. Thus, the antenna receipts unexpected radio signal and leads to error detection is prevented. Additionally, it is preferable to apply the present invention to the electronic cabinet which comprises a plurality of compartments. By setting the boundary radiation prevention structure around the compartments, the electromagnetic wave reflects after transmitting to the metal portion (which is the metal receptacle according to the working platform embodiment). Therefore, the goal of compartment is achieved. Furthermore, inhibiting of the evanescent wave and the boundary radiation generated by the induced current is achieved by the curved surface and absorption layer, so that the compartments of the electronic cabinet can be signally separated from each other.

While the present invention has been described in connection with certain exemplary embodiments, it is to be understood that the invention is not limited to the disclosed embodiment, but, on the contrary, is intended to cover various modifications and equivalent arrangement include within the spirit and scope of the appended claim, and equivalent thereof.

What is claimed is:

1. A boundary radiation prevention structure, comprising:

a metal portion, which has an incident plane adapted to block an incident electromagnetic wave from penetrating, wherein the incident electromagnetic wave induces an induced current on the incident plane; and a guide portion, which is located on one border of the incident plane and has a curved surface electrically connected to the metal portion thr the induced current to pass through, wherein the curved surface is covered by an absorption layer for absorbing the incident electromagnetic wave and a boundary radiation generated from the induced current radiation.

2. The boundary radiation prevention structure of claim 1, wherein the absorption layer is composed of a coating material.

3. The boundary radiation prevention structure of claim 1, wherein the absorption layer is composed of a composite material or a polymeric material.

4. The boundary radiation prevention structure of claim 1, wherein the absorption layer is surrounded by a protective sleeve.

5. The boundary radiation prevention structure of claim 1, wherein the absorption layer has an extended portion extending and covering from the curved surface to the incident plane.

6. An electronic cabinet with a boundary radiation prevention structure for placing at least one object attached with an electronic tag, wherein the electronic cabinet includes a plurality of compartments, each compartment comprises:

at least one antenna for coupling to the electronic tag;

a plurality of metal portions, each metal portion is located between two compartments and has two incident planes corresponding to the compartments respectively for blocking the incident electromagnetic wave across to another compartment, wherein the incident electromagnetic wave induces an induced current on the incident plane; and a plurality of guide portions, which are located between two incident planes and each guide portion has a curved surface electrically connected to the metal portion for the induced current to pass through, wherein the curved surface is covered by an absorption layer for absorbing of the incident electromagnetic wave and a boundary radiation generated from the induced current radiation.

7. The electronic cabinet of claim 6, wherein the absorption layer is composed of a coating material.

8. The electronic cabinet of claim 6, wherein the absorption aye composed of a composite material or a polymeric material.

9. The electronic cabinet of claim 6, wherein the metal portion has a first connecting part for connecting a second connecting part of the guide portion.

10. The electronic cabinet of claim 9, wherein the absorption layer has an extended portion extending and covering from the curved surface to the surface of the junction of the incident plane and the guide portion.

11. The electronic cabinet of claim 6, further comprising at least one tag recognition unit connected to the antenna for accessing the information of the electronic tag.

12. The electronic cabinet of claim 6, wherein the absorption layer is surrounded by a protective sleeve.

13. An electronic working platform with boundary radiation prevention structure for placing at least one object attached with an electronic tag, wherein the working platform comprises:

an antenna for coupling to the electronic tag;

a configuration container, comprising a top surface portion, a metal receptacle containing the antenna inside, and a plurality of guide portions located between the top surface portion and the edge of the metal receptacle, wherein the metal receptacle includes an incident surface for blocking an incident electromagnetic wave which induces an induced current on the incident surface, and the guide portion has a curved surface electrically connected to the metal portion for the induced current to pass through, and the curved surface is covered by an absorption layer for absorbing the incident electromagnetic wave and a boundary radiation generated from the induced current radiation.

14. The electronic working platform of claim 13, wherein the absorption layer is composed of a coating material.

15. The electronic working platform of claim 13, wherein the absorption layer is composed of a composite material or a polymeric material.

16. The electronic working platform of claim 13, further comprising at least one tag recognition unit connected to the antenna for accessing the information of the electronic tag.

17. The electronic working platform of claim 13, wherein the absorption layer is surrounded by a protective sleeve.

18. The electronic working platform of claim 13, wherein the absorption layer has an extended portion extending and covering from the curved surface to the incident surface.

* * * * *